US008482420B2

(12) United States Patent
Blossfeld et al.

(10) Patent No.: US 8,482,420 B2
(45) Date of Patent: Jul. 9, 2013

(54) METHOD OF MONITORING OIL IN A VEHICLE

(75) Inventors: Daniel H. Blossfeld, Novi, MI (US); Matthew J. Snider, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 403 days.

(21) Appl. No.: 12/857,648

(22) Filed: Aug. 17, 2010

(65) Prior Publication Data

US 2012/0044077 A1 Feb. 23, 2012

(51) Int. Cl.
*G08B 17/10* (2006.01)

(52) U.S. Cl.
USPC ..... 340/603; 340/457.4; 340/438; 340/439; 340/450; 701/107; 701/104; 701/29.5; 701/1; 701/123; 508/591; 508/485; 508/551; 508/486; 123/196 R; 123/196 S; 123/41.02; 324/663; 73/290 V; 184/6.4; 184/6.1; 184/108; 184/1.5

(58) Field of Classification Search
USPC ..... 184/6.4, 6.1, 108, 1.5; 508/485, 508/486; 340/457.4, 438, 439, 450, 450.1, 340/450.3; 123/196 R, 196 S, 295, 305, 443, 123/339.1; 324/663, 667; 701/29.5, 1, 99, 701/123, 104; 180/65.1
See application file for complete search history.

(56) References Cited

U.S. PATENT DOCUMENTS

| | | | | | |
|---|---|---|---|---|---|
| 4,742,476 | A * | 5/1988 | Schwartz et al. | 701/29.5 |
| 4,777,821 | A * | 10/1988 | Gerve | 73/290 V |
| 4,796,204 | A * | 1/1989 | Inoue | 123/196 S |
| 4,847,768 | A * | 7/1989 | Schwartz et al. | 701/29.5 |
| 4,862,393 | A * | 8/1989 | Reid et al. | 701/29.5 |
| 5,060,156 | A * | 10/1991 | Vajgart et al. | 701/29.5 |
| 5,382,942 | A * | 1/1995 | Raffa et al. | 340/457.4 |
| 5,633,796 | A * | 5/1997 | Cullen et al. | 701/29.5 |
| 5,687,687 | A * | 11/1997 | Trueblood et al. | 123/196 S |
| 5,831,154 | A * | 11/1998 | Guertler et al. | 73/114.56 |
| 6,208,245 | B1 * | 3/2001 | Post et al. | 340/457.4 |
| 6,253,601 | B1 * | 7/2001 | Wang et al. | 73/114.55 |
| 6,266,587 | B1 * | 7/2001 | Guertler et al. | 701/29.5 |
| 6,327,900 | B1 * | 12/2001 | McDonald et al. | 73/114.55 |
| 6,535,001 | B1 * | 3/2003 | Wang | 324/698 |
| 6,580,366 | B1 * | 6/2003 | Engfehr | 340/457.4 |
| 6,741,938 | B2 * | 5/2004 | Berndorfer | 702/23 |
| 6,917,865 | B2 * | 7/2005 | Arai et al. | 701/29.5 |
| 2004/0079589 | A1 * | 4/2004 | Schneider | 184/1.5 |
| 2004/0093150 | A1 * | 5/2004 | Arai et al. | 701/104 |

* cited by examiner

*Primary Examiner* — Benjamin C Lee
*Assistant Examiner* — Chico A Foxx
(74) *Attorney, Agent, or Firm* — Quinn Law Group, PLLC

(57) ABSTRACT

A method of monitoring oil in a vehicle having an internal combustion engine is provided. The method includes measuring a sump temperature of the engine and measuring a power output of the engine. Oil consumption is calculated as a function of the measured sump temperature and the measured power output. Remaining oil life is calculated as a function of the calculated consumption. The method may include alerting a receiver of the calculated remaining oil life.

12 Claims, 2 Drawing Sheets

METHOD OF MONITORING OIL IN A VEHICLE

TECHNICAL FIELD

This disclosure relates to monitoring of oil and oil life in internal combustion engines.

BACKGROUND

Various internal combustion engines utilize motor oil or engine oil for lubrication of moving parts, such as pistons and shafts. Gasoline engines and diesel engines both use motor oil derived from petroleum and non-petroleum base materials, and many include additive components. Most engines require periodic maintenance, which may include changing the oil, adding oil, or changing other components of the engine oil system. Depending upon the type of engine, the type of vehicle, the operating environment, and other factors, the maintenance schedule or cycle may vary.

SUMMARY

A method of monitoring oil in a vehicle having an internal combustion engine is provided. The method includes measuring a sump temperature of the engine and measuring a power output of the engine. Oil consumption is calculated as a function of the measured sump temperature and the measured power output. Remaining oil life is calculated as a function of the calculated consumption. The method may include alerting a receiver of the calculated remaining oil life.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
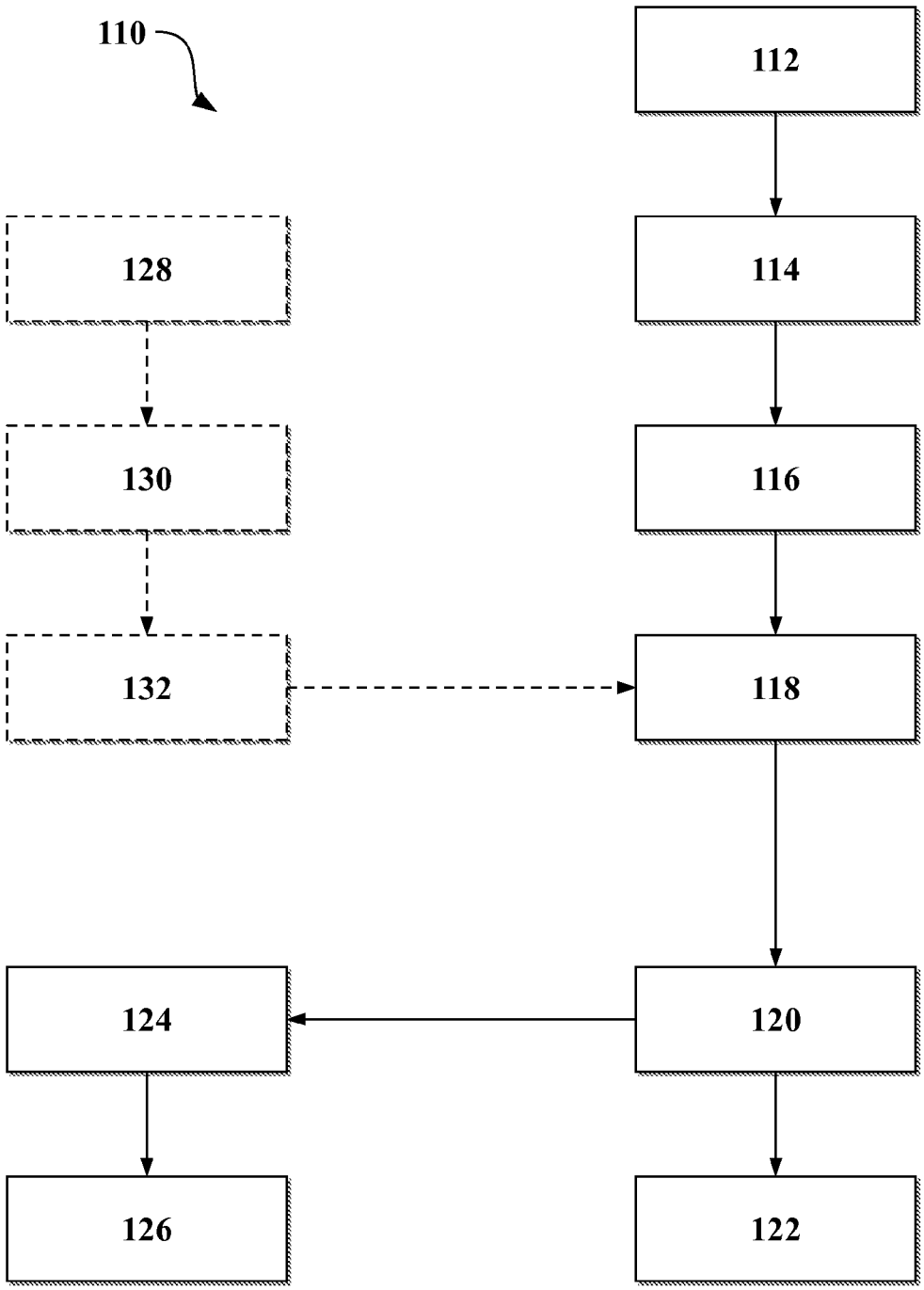
FIG. 1 is a schematic flow chart of an algorithm or method for monitoring engine oil volume and quality.

Referring to the drawings, wherein like reference numbers correspond to like or similar components throughout the several figures, there is shown in FIG. 1 a schematic flow chart of an algorithm or method 110 for monitoring engine oil volume and quality. The method 110 may be used with an internal combustion engine and may be a component or sub-algorithm of an engine oil life system. The method 110 is capable of determining or estimating the amount of oil consumed during operation of the engine and determining or estimating the remaining life of the oil.

While the present invention is described in detail with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims.

Step 112: Measure Sump Temperature. Oil passes through various parts of the engine for various purposes, including lubrication of the engine's moving parts. Motor oil also cleans, inhibits corrosion, improves sealing and cools the engine by carrying heat away from moving parts. The method 110 measures the temperature of oil in the oil sump, which is a reservoir where oil pools or collects, often at the bottom of the engine. The sump may be a wet sump or a dry sump. Sump oil may be redistributed to the engine through an oil pump and an oil filter.

The temperature of oil in the sump may be measured with a temperature sensor as the oil pools in the sump, enters the sump, or exits the sump to be recirculated. Measurements may be logged as instantaneous points (digital input) or as a constantly varying stream (analog input) of temperature data. The measured temperature data may also be averaged or may be filtered or smoothed.

The method 110 may become operational at any time when the engine is running or during diagnostic testing. The method 110 is illustrated as for a single loop or iteration, but may be continuously looping, have a fixed number of cycles, operate for a fixed time period, or may be started and stopped after any number of iterations. The method 110 may be executed by a dedicated controller or computer, or may be one of many algorithms executed by a larger controller or computer such as the engine control module (ECM) or hybrid control processor (HCP). The exact order of the steps of the algorithm or method 110 shown in FIG. 1 is not required. Steps may be reordered, steps may be omitted, and additional steps may be included.

Step 114: Measure Engine Power Output. The method 110 includes measuring a power output of the engine. As the engine operates, the power output of the engine is varied depending upon the needs of the operator (usually referred to as the driver) of the vehicle. The power output—which is often measured in horsepower—of the engine varies across the operating range—which is often measured in revolutions per minute—of the engine. Power output may be measured or computed based upon airflow and fuel utilized for combustion, or may be modeled based upon other operating conditions of the engine or the vehicle.

Step 116: Measure Event Lapse. The events and event lapse may be measured in revolutions of the engine or combustion events of the engine. In many vehicles combustion events and revolutions are directly related. However, in variable displacement engines, these events are not always directly proportional.

Alternatively, engine run time may be used as the unit of measurement, or run time may be combined with revolutions or combustion events. The method 110 tracks or measures the passage of time or the lapse (occurrence) of events in order to determine the amount of oil consumed. Additionally, the event lapse may be used to determine the remaining life of the oil.

Figure 2:
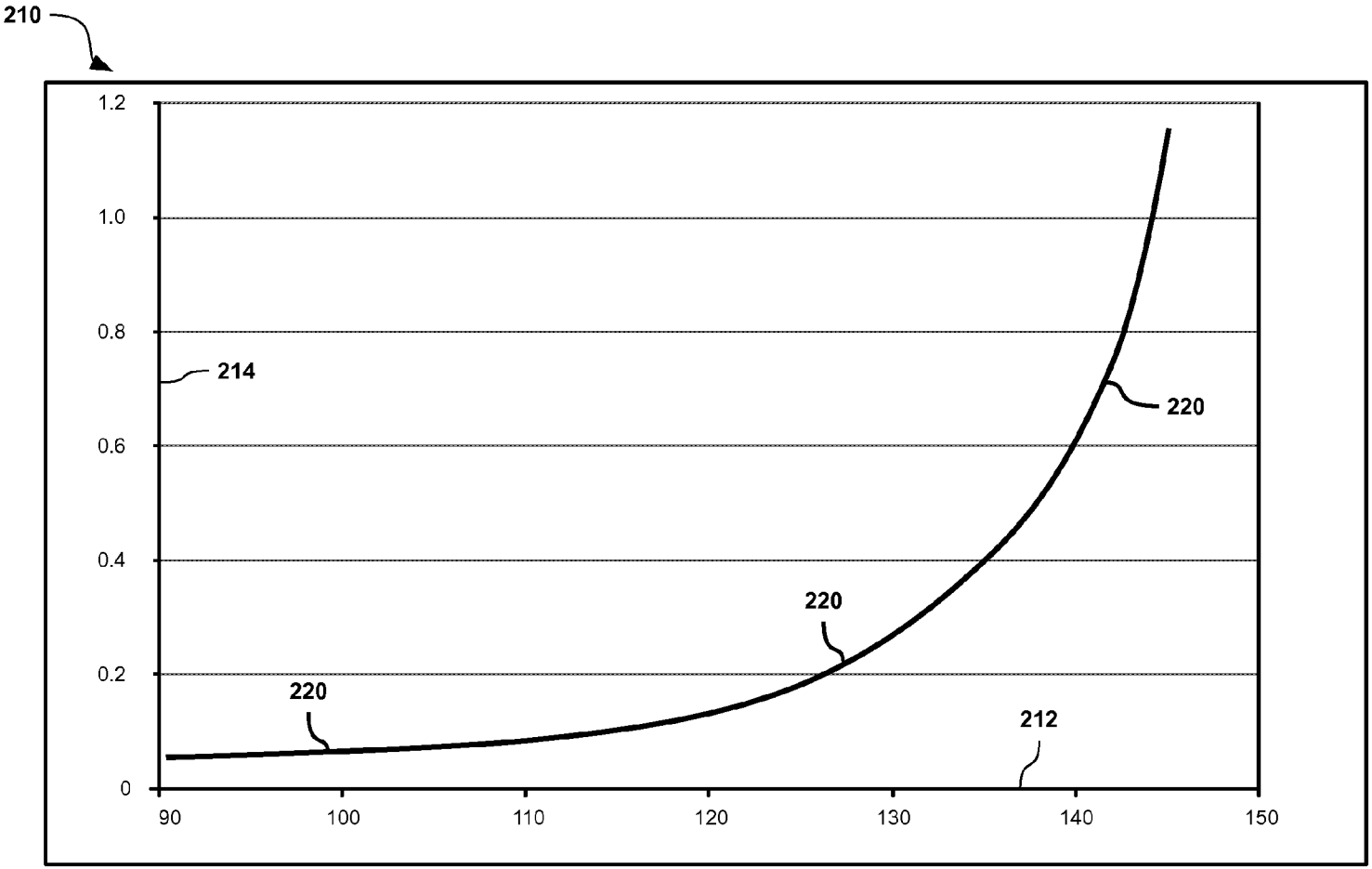
FIG. 2 is a schematic graph of oil consumption as a function of sump temperature and engine power.

Step 118: Calculate Oil Consumption. The method 110 includes calculating oil consumption as a function of the measured sump temperature and the measured power output. Referring to FIG. 2, and with continued reference to FIG. 1, there is shown a schematic graph 210 of oil consumption as a function of sump temperature and engine power. Determination and derivation of the graph 210 (and similar graphs) will be discussed with reference to steps 128-132.

The x-axis 212 of the graph 210 shows sump temperature of the engine. The y-axis 214 of the graph 210 shows oil consumption rates per power output unit of the engine. For example, and without limitation, the temperature along the x-axis 212 may be expressed in degrees Celsius. For example, and without limitation, the oil consumption per power output unit along the y-axis 214 may be expressed in grams per hour per horsepower. A line 220 is an approximation of the relationship between temperature and oil consumption rate, and may be a trendline approximating individual data points.

At step 118, the method 110 takes the measured sump temperature from step 112 and the measured power output from step 114 and determines the oil consumption rate for the current operating conditions. The oil consumption rate may be calculated as an individual data point, multiple data points, or may be averaged or integrated to determine the total consumption over an engine operating cycle. For example, and without limitation, oil consumption may be sampled once every few seconds throughout use of the vehicle for a whole calendar day and then integrated to determine the total amount of oil consumed on that day. Alternatively, the amount of oil consumed may be calculated during a driving trip (such as from ignition to vehicle shutdown) and the amount of oil consumed during the driving trip may be registered and logged by the controller.

Step 120: Calculate Oil Volume. The method 110 calculates an oil volume of the engine as a function of the calculated oil consumption. For example, and without limitation, the controller may know that the engine began with five quarts of oil and that after ninety days step 118 had determined that approximately one quart of oil had been consumed. The method 110 may then calculate that approximately four quarts of oil remain in the engine and the sump.

Step 122: Oil Volume Alert. The method 110 may include alerting a receiver of the calculated oil volume. Depending upon the oil volume calculated in step 120, the controller may store or log the oil volume for later use or diagnostics, or the controller may alert a receiver of the current oil volume. If, for example, oil volume drops to levels which greatly increase the likelihood of damage to the engine, the controller may alert a receiver on the vehicle instrument panel, such as a warning light or other display. If the vehicle is equipped with more-advanced communication capabilities—such as cellular, wireless internet, or satellite communications—the controller may broadcast the oil volume level to the communications network, thereby alerting the network, the operator, or a nearby service organization.

Step 124: Calculate Remaining Oil Life. The method 110 may include calculating a remaining oil life as a function of the calculated oil volume. Generally, as oil is consumed, the remaining oil may degrade more quickly than if there were a higher volume of oil. Therefore, if the controller is configured to estimate the remaining oil life, the controller may incorporate the oil volume calculated in step 120 into the calculation of the remaining oil life. For example, the controller may have predicted that the engine oil would not need to be changed for approximately sixty days. However, if step 120 determines that significant oil consumption has occurred, the controller may need to reduce the estimated time until an oil change is necessary.

Alternatively, the calculated remaining oil life may be measured in revolutions of the engine or combustion events of the engine. Measuring in revolutions or combustion events may allow the controller to account for both increased and decreased amounts of driving per day or relative to other time-based measurements. Vehicle mileage may also be used as the event units measured and logged by the controller and the method 110. Because oil consumption and oil volume are closely related, the remaining oil life may be calculated directly from oil consumption, without first calculating oil volume in step 120.

Step 126: Oil Life Alert. Once oil life has been determined, the method 110 may alert a receiver of the calculated remaining oil life. The type of alert may vary based upon the calculated remaining oil life. If, for example, step 124 determines that the oil life is roughly ninety percent of a predicted life span of one hundred day, step 126 may alert the controller such that it is accessible if the vehicle operator wishes to view the estimated oil life. However, if the calculated oil life is only five percent of the predicted life span, step 126 may include alerting the operator of the vehicle directly by activating a warning light or displaying the oil life on the instrument panel. Furthermore, if the vehicle is connected to a communications network, step 126 may include alerting the network of the reduced oil life and the need to change the engine oil.

Step 128: Determine Oil Consumption Rates. In order to calculate the remaining oil life in step 124, the controller needs to know the expected oil consumption rates of the engine. Therefore, the method 110 may include determining oil consumption rates which may be stored in the controller.

Step 130: Regression Analysis. The oil consumption rates may be similar to the graph 210 shown in FIG. 2, or may be stored as a function having sump temperature (Sump_T) and engine power (HP) as function inputs. In order to derive either a function formula or the graph 210, method 110 may include testing of representative engines. From the test results, regression analysis may be used to determine a trendline or curve fit from the test results. For example, the oil consumption trendline may be expressed as a function: Oil_Consumption=A+B*exp(C*Sump_T)*HP; where A, B, and C are constants. This function is then stored in the controller and used by the method 110 in step 118 to calculate oil consumption.

Step 132: Lookup Table. Instead of solving the equation above, the method 110 may utilize one or more lookup tables to determine the oil consumption. For example, a lookup table having the measured sump temperature from step 112 and the measured power output from step 114 as table inputs may output the oil consumption or an oil consumption rate (in mass per time). The lookup table used in step 132 may be derived from the regression analysis of step 130, or may be derived directly from testing of numerous operating points of the engine.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A method of monitoring oil in a vehicle having an internal combustion engine, the method comprising:

measuring a sump temperature of the engine;

measuring a power output of the engine;

calculating an oil consumption as a function of the measured sump temperature and the measured power output;

calculating an oil volume of the engine as a function of the calculated oil consumption; and calculating a remaining oil life as a function of the calculated oil volume.

2. The method of claim 1, wherein the calculating remaining oil life includes reference to a lookup table.

3. The method of claim 2, wherein the lookup table is derived from regression analysis.

4. The method of claim 3, wherein the calculated remaining oil life is measured in one of revolutions of the engine and combustion events of the engine.

5. The method of claim 4, further comprising alerting a receiver of the calculated remaining oil life.

6. The method of claim 5, further comprising communicating the calculated remaining oil life from the receiver to an operator of the vehicle.

7. The method of claim 4, further comprising alerting a receiver of the calculated oil volume.

8. A method of monitoring oil in a vehicle having an internal combustion engine, the method comprising:

measuring a sump temperature of the engine;

measuring a power output of the engine;

calculating an oil consumption as a function of the measured sump temperature and the measured power output;

calculating a remaining oil life as a function of the calculated consumption; and alerting a receiver of the calculated remaining oil life.

9. The method of claim 8, further comprising alerting a receiver of the calculated oil volume.

10. The method of claim 9, further comprising calculating an oil volume of the engine as a function of the calculated oil consumption.

11. The method of claim 10, wherein the calculated remaining oil life is measured in one of revolutions of the engine and combustion events of the engine.

12. The method of claim 11, further comprising alerting a receiver of the calculated oil volume.

* * * * *